US008545276B2

(12) United States Patent
Farahani

(10) Patent No.: US 8,545,276 B2
(45) Date of Patent: Oct. 1, 2013

(54) MULTI-PIN BREAKAWAY CONNECTOR WITH FIXED AND RETRACTABLE PINS

(76) Inventor: Fereidoun A. Farahani, Woodbridge, CT (US)

( * ) Notice: Subject to any disclaimer, the term of this patent is extended or adjusted under 35 U.S.C. 154(b) by 0 days.

(21) Appl. No.: 13/288,521

(22) Filed: Nov. 3, 2011

(65) Prior Publication Data

US 2013/0115791 A1 May 9, 2013

(51) Int. Cl.
*H01R 13/24* (2006.01)

(52) U.S. Cl.
USPC ..... 439/700

(58) Field of Classification Search
USPC ..... 439/700, 824, 166, 170–175, 180, 439/221, 218, 266, 268–270, 131, 289
See application file for complete search history.

(56) References Cited

U.S. PATENT DOCUMENTS

| | | | | |
|---|---|---|---|---|
| 3,308,415 | A | 3/1967 | Cramer et al. | |
| 4,684,192 | A | 8/1987 | Long et al. | |
| 6,910,911 | B2 | 6/2005 | Mellott et al. | |
| 7,070,458 | B2 | 7/2006 | Axenbock et al. | |
| 7,140,897 | B2 | 11/2006 | Axenbock et al. | |
| 7,371,116 | B2 * | 5/2008 | Chiang | 439/607.34 |
| 7,559,805 | B1 * | 7/2009 | Yi et al. | 439/660 |
| 7,572,146 | B1 * | 8/2009 | Chiang | 439/607.01 |
| 7,597,588 | B1 * | 10/2009 | Hyzin et al. | 439/578 |
| 7,806,704 | B2 * | 10/2010 | Miyoshi et al. | 439/108 |
| 7,878,834 | B2 * | 2/2011 | Sherman et al. | 439/324 |
| 7,967,641 | B2 * | 6/2011 | Miyoshi | 439/660 |
| 8,133,078 | B2 * | 3/2012 | Lin et al. | 439/660 |
| 8,303,329 | B2 * | 11/2012 | Wu | 439/395 |
| 2009/0264004 | A1 * | 10/2009 | Sherman et al. | 439/324 |
| 2010/0015831 | A1 * | 1/2010 | Miyoshi | 439/218 |

* cited by examiner

*Primary Examiner* — Ross Gushi
(74) *Attorney, Agent, or Firm* — St. Onge Steward Johnston & Reens LLC

(57) ABSTRACT

A breakaway connector assembly which has first connector having a first housing, a plurality of retractable pins attached to the housing, and a plurality of fixed pins attached to the housing and circumscribing the plurality of retractable pins. A second connector is matable to the first connector, the second connector having a plurality of contacts adapted to engage the plurality of fixed pins.

17 Claims, 5 Drawing Sheets

MULTI-PIN BREAKAWAY CONNECTOR WITH FIXED AND RETRACTABLE PINS

FIELD OF THE INVENTION

The present invention relates generally to a breakaway connector, and more specifically, relates to a multi-pin breakaway connector with fixed and retractable pins capable of connecting to connectors with differing numbers of contacts.

BACKGROUND OF THE INVENTION

Breakaway connectors are used in various applications including in connections between military headphones and military vehicles. Breakaway connectors are advantageous in that the connection is easily broken upon a predetermined amount of force rather than a connection that resists any disconnection. This prevents the equipment attached to one side of the connection from being damaged due to a pulling force from the other side of the connection. In military applications, such as military headphones attached to military vehicles, a breakaway connection allows the wearer to easily disconnect the headphones without removing the headphones from the wearer. The breakaway connection also prevents the wearer of the headphones from being dragged along with the vehicle if the vehicle were to move while the wearer was outside of the vehicle. At present, most breakaway connectors for military applications are seven pins. There is a desire for improved connectors having alternate pin counts and arrangements, however, the cost of changing to a different connector is prohibitive.

U.S. Pat. No. 3,308,415 to Cramer et al. discloses a three-prong electric plug in which the third prong is a retractable U-shaped ground pin. This feature allows for the plug to be compatible with a two-prong outlet or a three-prong outlet. The third prong includes a spring to keep it in a projected position, and is retracted by rotating the third prong. A disadvantage of this device is that it is not a breakaway connector. Additionally, the retractable prong is only capable of connecting to a ground connection.

U.S. Pat. No. 4,684,192 to Long et al. discloses a breakaway electrical connector having a latching mechanism that is matable and detachable upon application of a certain level of axial tensile force. This is achieved by using spring-loaded guide pins on one of the two connectors that provide a resisting force to the second connector. A disadvantage of this device is that the guide pins are only used to prevent an "unlatched" connection and are not part of the electrical connection.

U.S. Pat. No. 6,910,911 to Mellott et al. discloses an electrical connector in which the plug portion will break away from the terminal portion when the force applied to the plug portion reaches a specific magnitude in order to prevent damage to the connector. The contacts are spring loaded and retractable so that the contacts can be substantially flush with the mating surface. A disadvantage of this device is that the connector is not intermatable with connectors having a lesser number of wires or contacts.

U.S. Pat. No. 7,070,458 to Axenbock et al. discloses a spring-loaded contact connector having axially displaceable contacts. The spring-loaded contact connectors are used to provide a stable connection under a variety of environmental conditions. A disadvantage of this device is that the connector is not intermatable with connectors having a lesser number of wires or contacts.

What is desired, therefore, is a breakaway connector that is intermatable with connectors having differing numbers of contacts.

SUMMARY OF THE INVENTION

The invention is directed to a breakaway connector with retractable pins. The retractable pins allow the connector to be connected to different connectors having differing numbers of pins.

It is an object of the present invention to provide a multi-pin connector that is compatible with both existing 7-pin connectors and new connectors having a number of pins greater than seven.

It is a further object of the present invention to allow a user to buy and/or utilize new equipment having connectors with a greater number of pins without having to replace current equipment that requires a 7 pin connection.

By installing the breakaway connector described herein that is intermatable with 7- and 10-pin connectors on new equipment, the user can mate the connector with existing 7-pin plugs as well as 10-pin plugs that are installed on new equipment. When mating with an existing 7-pin plug, the three pins not in use are retracted. When mating with a connector with more than seven pins, all required pins will remain extended and will engage for a secure connection.

These and other objects of the present invention are achieved by provision of a connector with a housing, a plurality of retractable pins attached to the housing, and a plurality of fixed pins attached to the housing and circumscribing the plurality of retractable pins. The retractable pins retract upon connection to a further connector having fewer contacts than a total of the plurality of retractable pins and the plurality of fixed pins.

In some of these embodiments, the retractable pins are spring loaded. In some of these embodiments, the connector has at least seven fixed pins. In some of these embodiments, the connector has at least three retractable pins. In some of these embodiments, the retractable pins are capable of moving in a lateral direction sliding against each other.

In another embodiment of the present invention is a connector, with a housing, a plurality of fixed pins attached to the housing, and a plurality of spring loaded retractable pins attached to the housing. The spring loaded retractable pins are movable from a retracted position substantially inside an inner surface of the housing and an extendable position extending from the inner surface of the housing.

In some of these embodiments, the connector has at least seven fixed pins. In some of these embodiments, the connector has at least three retractable pins. In some of these embodiments, the retractable pins are capable of moving in a lateral direction sliding against each other.

In another embodiment of the present invention is a breakaway connector assembly with a first connector having a first housing, a plurality of retractable pins attached to the housing, and a plurality of fixed pins attached to the housing and circumscribing the plurality of retractable pins. A second connector is matable to the first connector, the second connector having a plurality of contacts adapted to engage the plurality of fixed pins.

In some of these embodiments, the second connector is adapted to engage the plurality of retractable pins. In some of these embodiments, the retractable pins are spring loaded. In some of these embodiments, the first connector has at least seven fixed pins. In some of these embodiments, the first connector has at least three retractable pins. In some of these embodiments, the second connector has at least seven contacts. In some of these embodiments, the second connector has at least ten contacts. In some of these embodiments, the retractable pins are capable of moving in a lateral direction sliding against each other.

DETAILED DESCRIPTION OF THE INVENTION

Figure 1:
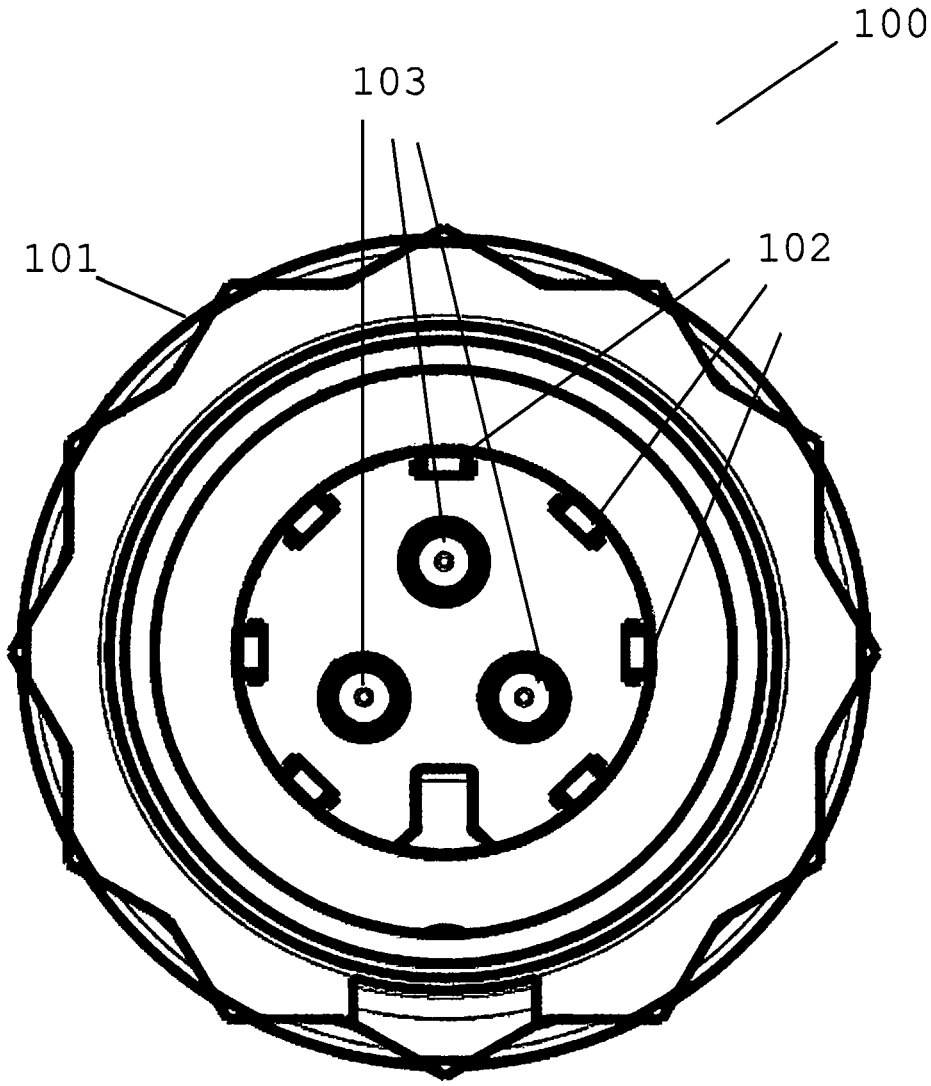
FIG. 1 is a cross-sectional view of the end of a connector according to an exemplary embodiment of the invention.

The exemplary embodiments of the present invention may be further understood with reference to the following description and the related appended drawings, wherein like elements are provided with the same reference numerals. The exemplary embodiments of the present invention are related to a breakaway connector capable of connecting to corresponding connectors having differing numbers of contacts. Specifically, the device has a plurality of retractable pins which retract when connected to a connector having less corresponding contacts. The exemplary embodiments are described with reference to a connector capable of connecting to a 7-pin and a 10-pin connector, but those skilled in the art will understand that the present invention may be implemented on any breakaway connector having any number of pins.

Figure 3:
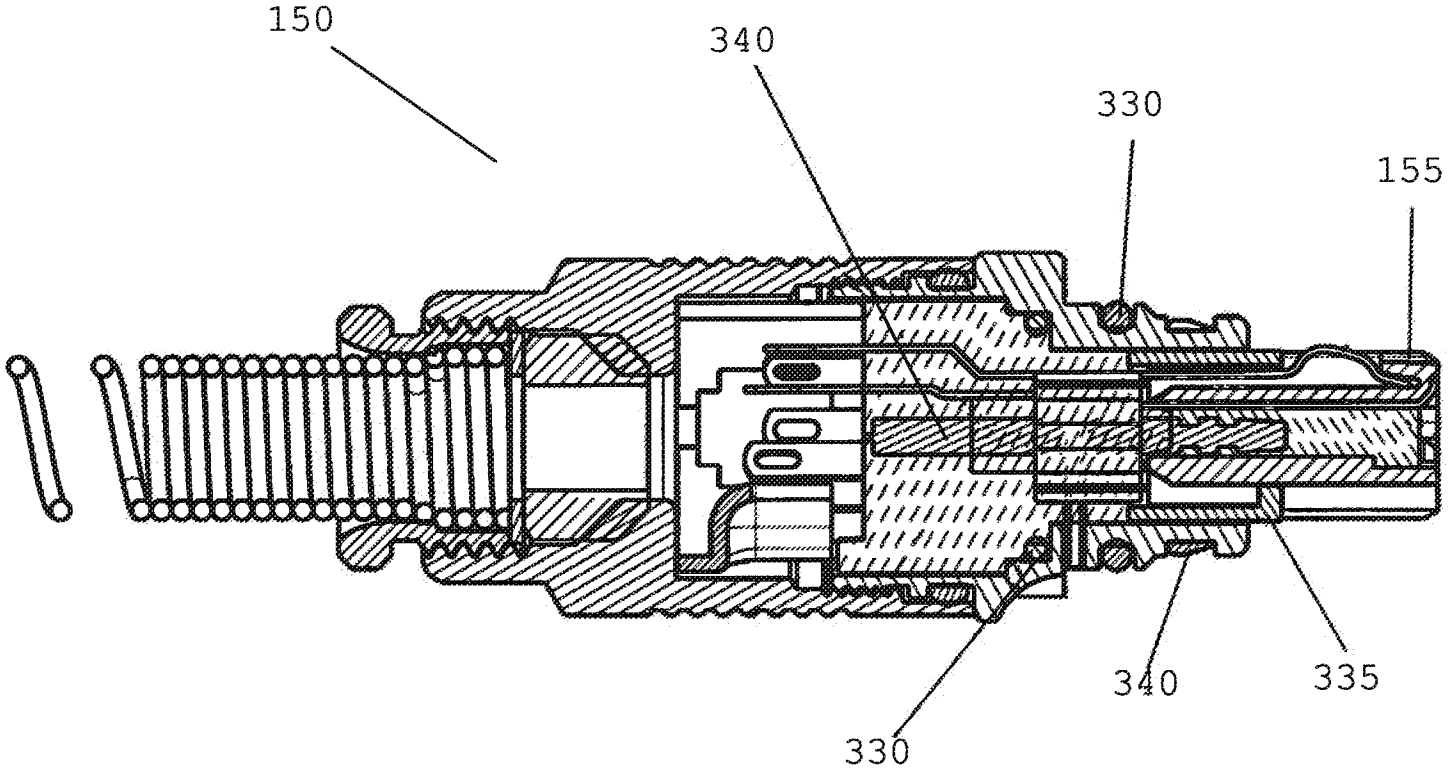
FIG. 3 is a cross-sectional view of the mating connector of FIG. 1.

As best seen in FIG. 1, a cross-sectional view of a breakaway connector 100 is shown. Connector 100 is a jack having at least ten pins and is adapted to connect to an insert plug 150 (FIG. 3). Connector 100 and insert plug 150 are preferably made from an aluminum shell to provide a sturdy and durable shell for secure mating. Connector 100 and insert plug 150 are adapted for self-align snap engagement with each other. Connector 100 includes a housing. Housing 101 may be connected to a steel spring like structure 240 to house the incoming wires connected to the pins of connector 100. Housing 101 may have a rubber shell 220, a rubber contact 225, a rubber O-ring 230, and an aluminum guide 235 to help mate connector 100 to insert jack 150. Additionally, insert jack 150 may have a plurality of rubber O-rings 330, a nylon bushing 335, and a snap ring 340 to help mate connector 100 with insert jack 150. A steel shaft 340 is used to provide structure and support for insert jack 150.

Housing 101 has a plurality of fixed pins 102 which circumscribe a plurality of retractable pins 103. Fixed pins 102 and retractable pins 103 are preferably made from brass or gold to facilitate an enhanced signal transfer between the connectors. When connector 100 is mated with a corresponding connector having an equal number of contacts, all pins from connector 100 are used. If the corresponding connector has fewer contacts than the total number of pins in connector 100, some or all of retractable pins 103 can retract to allow mating.

Figure 2A:
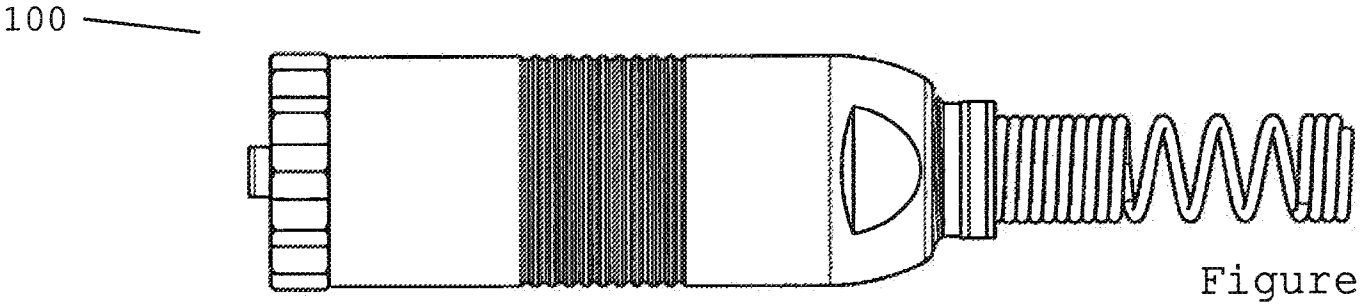
FIG. 2A is a partially exposed view of the connector shown in FIG. 1.
Figure 2B:
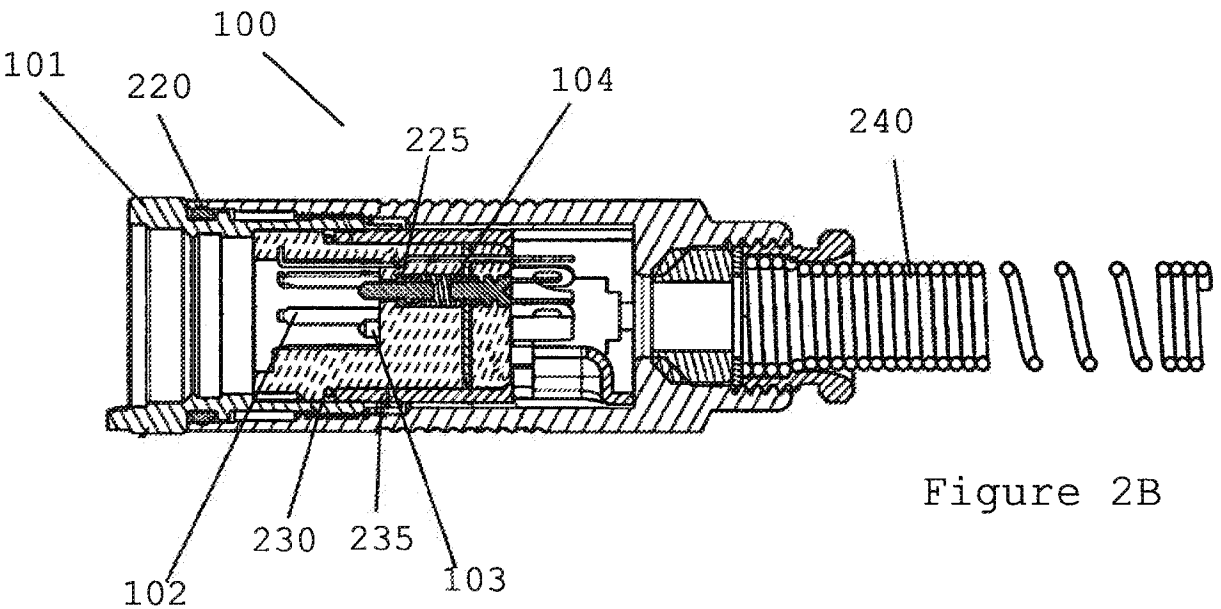
FIG. 2B is a side view of the connector show in FIG. 2A.

As best seen in FIGS. 2A and 2B, a side view and a partially exposed view of the connector 100 is shown. Retractable pins 103 may be driven by a spring 104 or any other similar device that allows pins 103 to be extended and retracted. Retractable pins 103, using springs 104, allow the connector 100 to mate with a corresponding plug 150, having a number of contacts equal to or less than the total number of fixed pins 102 and retractable pins 103. Mating connector 150 has a male extension portion 155 that fits inside of connector 100.

When retractable pins 103 are in the retracted position, they are substantially inside an inner surface 107. When retractable pins 103 are in the extended position, they extend from inner surface 107.

Figure 4A:
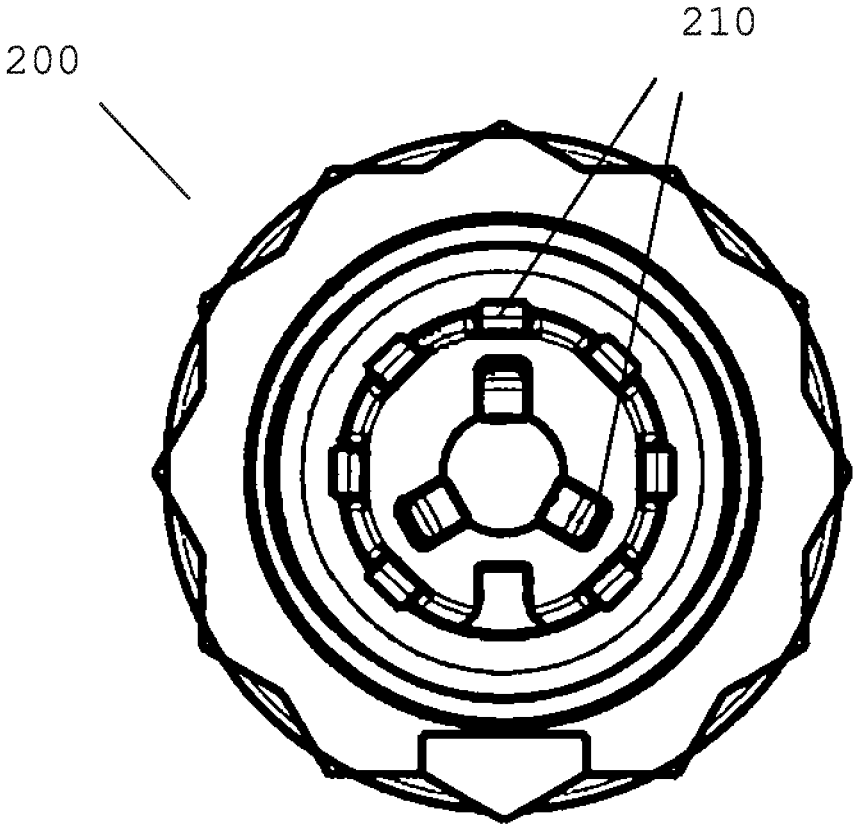
FIG. 4A is a cross-sectional view of the mating end of the corresponding connector of FIG. 3 having ten contacts.
Figure 4B:
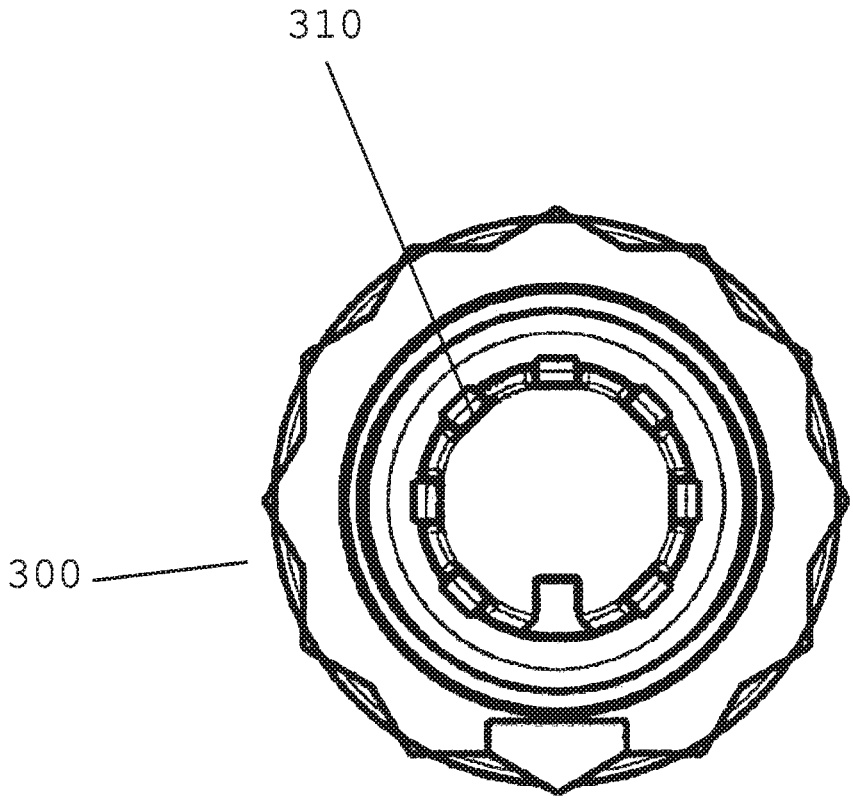
FIG. 4B is a cross-sectional view of the mating end of a corresponding connector of FIG. 3 having seven contacts.

In the exemplary embodiment of FIGS. 1 and 2, connector 100 has seven fixed pins 102 and three retractable pins 103. The connector 100 is adapted such that it is matable with both ten-pin plugs 200 and seven-pin plugs 300 (FIGS. 4A and 4B respectively). Retractable pins 103 are capable of movement in a direction other than strictly in our out relative to plugs 200 or 300. Retractable pins 103 are capable of sliding on each other, and can move in a lateral direction causing a wiping motion. This wiping motion allows for a superior connection between retractable pins 103 and their corresponding contact by clearing dirt build-up from the face of retractable pins 103 and contacts 210.

As best seen in FIG. 4A and FIG. 4B, cross-sectional views of connectors 200 and 300, which are adapted to mate with connector 100, are shown. When the connector 100 is mated with the plug of FIG. 4A, all of the fixed pins 102 and the retractable pins 103 are required in order to engage the ten contacts 210 of female plug 200. When the connector 100 is mated with a plug 300 having only seven contacts 310, the retractable pins 103 are not required, and retract to allow a secure connection with the remaining fixed pins 102 and contacts 310.

This breakaway connector has the advantage in that it can be used with multiple corresponding connectors having differing numbers of contacts. This prevents the need to replace existing equipment, saving the large cost associated with upgrading or replacing existing equipment.

Although the invention has been described with reference to a particular arrangement of parts, features and the like, these are not intended to exhaust all possible arrangements or features, and indeed many modifications and variations will be ascertainable to those of skill in the art.

What is claimed is:

1. A connector, comprising:

a housing;

a plurality of retractable pins attached to said housing;

a plurality of fixed pins attached to said housing and circumscribing said plurality of retractable pins;

wherein each retractable pin is in a retracted position when said connector is connected to a further connector that lacks a contact adapted to engage that retractable pin and each retractable pin is in an extended position when said connector is connected to a further connector that comprises a contact adapted to engage that retractable pin.

2. The connector according to claim 1, wherein said retractable pins are spring loaded.

3. The connector according to claim 1, wherein said connector comprises at least seven fixed pins.

4. The connector according to claim 1, wherein said connector comprises at least three retractable pins.

5. The connector according to claim 1, wherein said retractable pins are capable of moving in a lateral direction sliding against each other.

6. A connector, comprising:

a housing;

a plurality of fixed pins attached to said housing;

a plurality of spring loaded retractable pins attached to said housing, said spring loaded retractable pins movable from a retractable position substantially fully inside an inner surface of the housing and an extendable position extending from said inner surface of said housing;

wherein said connector comprises at least seven fixed pins.

7. The connector according to claim 6, wherein said connector comprises at least three retractable pins.

8. A connector, comprising:

a housing;

a plurality of fixed pins attached to said housing;

a plurality of spring loaded retractable pins attached to said housing, said spring loaded retractable pins movable from a retractable position substantially inside an inner surface of the housing and an extendable position extending from said inner surface of said housing;

wherein said retractable pins are capable of moving in a lateral direction sliding against each other.

9. The connector according to claim 8, wherein said connector comprises at least three retractable pins.

10. A breakaway connector assembly, comprising:

a first connector comprising:

a first housing;

a plurality of retractable pins attached to said housing; and a plurality of fixed pins attached to said housing and circumscribing said plurality of retractable pins;

a second connector matable to said first connector, said second connector comprising a plurality of contacts adapted to engage said plurality of fixed pins.

11. The breakaway connector assembly according to claim 10, wherein said retractable pins are spring loaded.

12. The breakaway connector assembly according to claim 10, wherein said first connector comprises at least seven fixed pins.

13. The breakaway connector assembly according to claim 10, wherein said first connector comprises at least three retractable pins.

14. The breakaway connector assembly according to claim 10, wherein said second connector comprises at least seven contacts.

15. The connector according to claim 10, wherein said retractable pins are capable of moving in a lateral direction sliding against each other.

16. The breakaway connector assembly according to claim 10, wherein said second connector is adapted to engage said plurality of retractable pins.

17. The connector according to claim 16, wherein said second connector comprises at least ten contacts.

* * * * *